US005367974A

United States Patent [19]

Moraga et al.

[11] Patent Number: 5,367,974

[45] Date of Patent: Nov. 29, 1994

[54] MULTIPLE USE WATER VEHICLE

[76] Inventors: Claudio E. Moraga; Leopoldo Villabla, both of Echeverria 3599, Capital Federal, Argentina

[21] Appl. No.: 560,064

[22] Filed: Mar. 7, 1990

[30] Foreign Application Priority Data

Dec. 13, 1989 [AR] Argentina ..... 315.654

[51] Int. Cl.[5] ..... B63B 7/00

[52] U.S. Cl. ..... 114/345; 441/40; 114/283

[58] Field of Search ..... 114/345, 270, 292, 123, 114/283, 61; 441/65, 66, 35–40

[56] References Cited

U.S. PATENT DOCUMENTS 3,702,106 11/1972 Wilder ..... 114/123

4,964,357 10/1990 Genfan ..... 114/123

*Primary Examiner*—Jesus D. Sotelo

*Attorney, Agent, or Firm*—Kuhn and Muller

[57] ABSTRACT

MULTIPLE USE WATER VEHICLE characterized in that it comprises an elongated floating assembly e) which, provided with propelling means m), steering means c) and gripping means 4) is formed by a principal float 1) which includes a stabilizer 5) and two lateral pontoons 2), all of them connected with each other by a least one rigid structure (3–4), the principal float 1) having an access opening which, having a section that may permit a person to go in, is tightly closed by a lid 7).

4 Claims, 5 Drawing Sheets

MULTIPLE USE WATER VEHICLE

BACKGROUND AND FIELD OF THE INVENTION

The present invention refers to a multiple use water vehicle whose object is a new type of floating vessel that may permit not only its motion under optimal conditions of floatability, but also, owing to its structure, it may permit the rescue of persons from the water, (especially in areas of wave break), to lift goods and structures of all types from liquid media, to transport goods and to practice sports or entertainment activities, etc.

Some types of pneumatic floating vessels are already known such as rubber boats and similar ones which are suitable to render some types of services and activities. These known pneumatic floating vessels raise several problems; among said problems is that they retain water between the pneumatic structures that form its walls and the floor.

Catamarans, whose structure is mounted on sets of floating pontoons are equally known. They also pose the problem of collecting water, which results in their instability (the floatation line varies and is uncontrollable); this fact makes them unsuitable for use in big wave areas such as the sea.

The new water vehicle described-in the present invention has faced and overcome the problems stated above by means of a floating structure that may be rigid (hard) or inflatable ,pneumatic with flexible walls in such a way that it not only has the advantage of not collecting water, but, if there happened to occur a breakage or puncture in one of the pontoons or in the principal float, the structure continues to operate without sinking, thus permitting it to arrive at a safe place to repair the damage.

Another advantage of the invention consists in including a stabilizer which is formed of a watertight compartment that can be fed through an orifice which is plugged from outside, thus permitting to add or to remove ballast (for example liquid), so as to vary the flotation line of the vessel and, consequently, to vary its stability. This makes it suitable to the conditions of the liquid medium wherein it moves (i.e. if the water is very calm the flotation line goes down and it is possible to navigate with larger projection of the vehicle above the water level, whereas in case of surge, the flotation line goes up and it becomes necessary to increase the weight by adding ballast into the stabilizer compartment).

Another advantage of the invention is the possibility of using the vessel for rescuing persons from the water; this can be done by means of lateral belts which permit hoisting the persons on board in a horizontal position relatively easily, taking into consideration that hoisting people from the water is usually a rather difficult operation.

Another purpose of the invention is to permit the use of the principal float as an emergency decompressor chamber, applicable to swimmers who, in the course of a diving practice, have had, for some reason, to rapidly ascend to the surface.

A further application of the vessel is to use it for quick motion with a small part under water (as the boat heels over separating its bow from the water), by means of the use of sliding skis provided on the base of the pontoons, which permit its motion in snow or ice with an eolic drive engine and which also permits varying the water line.

One further possibility is to use the stabilizer compartment as an auxiliary water or fuel deposit to the effect of increasing the autonomy of the vehicle or to permit the transport of liquids plus the additional feature that said compartment may come optionally with a partition wall for counteracting the rolling effect to some extent.

Apart from the above stated, further advantages and purposes of the invention will be disclosed in the course of the specifications.

For the above stated reasons, it is easy to imagine the acceptance of the invention is to have when put into practice, whatever may be its category and destination since, owing to its characteristics, it can be used for economical transport of persons and/or cargos as well as for rescuing operations, sports and entertainment, hoisting or removing goods from the water, etc.

PRINCIPAL OBJECT

In accordance with the following description and for the specified purposes, the multiple use water vessel is characterized in that it comprises an elongated floating set of components a) which, provided with propelling means (m), steering means (c) and gripping means (4). The multiple use water vehicle includes a principal float (1) which includes therein a stabilizer compartment (5), and two pontoons (2), all of them laterally placed adjacent to each other and interconnected by means of a rigid structure (3–4) the principal float (1) being provided with an opening which has a section that permits access to a human being and closes tightly by means of a lid (7).

BRIEF DESCRIPTION OF THE DRAWINGS

For the sake of further clarity and of a better understanding of the object of the invention, the same is illustrated in several figures wherein it has been depicted in some of its preferred embodiments, said illustrations constituting mere examples and being by no means taxative.

Figure 1:
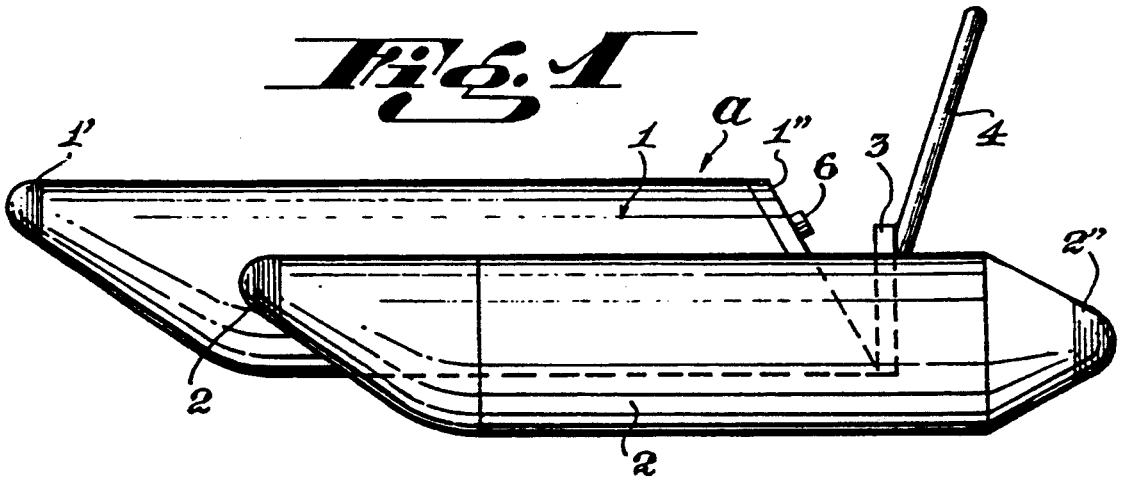
FIG. 1: a lateral view of the vehicle which illustrates particularly the floating set.

In the different figures, reference numbers indicate the same or a corresponding part and sets of elements have been referenced with letters.

References correspond to the following detail, wherein:

a) floating assembly
c) control
d) rigid structure
m) propelling means
p) windscreen
1) principal float of c)
1') extremity or bow of 1)
1") rigid bottom wall of 1)
2) lateral pontoons of c)
2') extremity or bow complements in 2)
2") stern extremity of 2)
3) transversal rigid wall of the transom
4) rigid structure "U" bar
5) stabilizer of 1)
5') liquid (ballast, water, fuel, etc.), can be loaded in 5)
6) Loading orifice of 5)
7) hatchway of 1")
8) air hose to feed 1)
9) air chuck of 8)
10) manometer
11) tubes for pneumatic admission and control to 1)
12) lateral rescuing belts
13) anchoring base of the rigid structure provided in 2)
14) rigging control handle in g)
15) hoist hooking
16) belt and floor tighteners
17) skis

BRIEF DESCRIPTION OF THE PREFERRED EMBODIMENT

Figure 2:
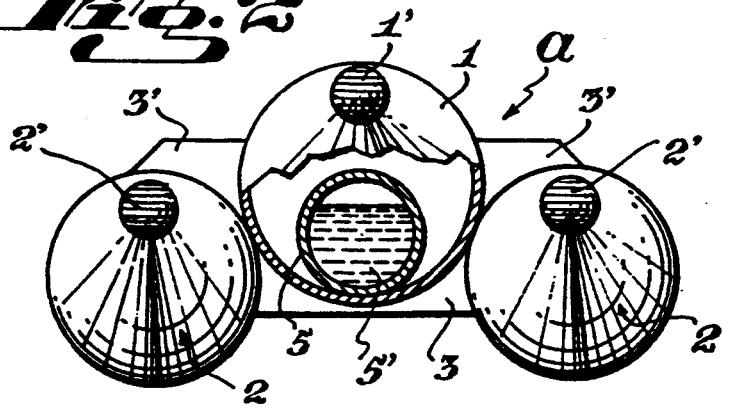
FIG. 2: a front view of the floating set illustrating the principal float, the principal float having a larger diameter and the lateral pontoons having a bow transversal rigid frame; the same also shows a partial section of the principal float illustrating the presence of the stabilizing chamber compartment inside the principal float, which compartment is loaded with liquid to act as ballast; the liquid may be fuel or others.
Figure 3:
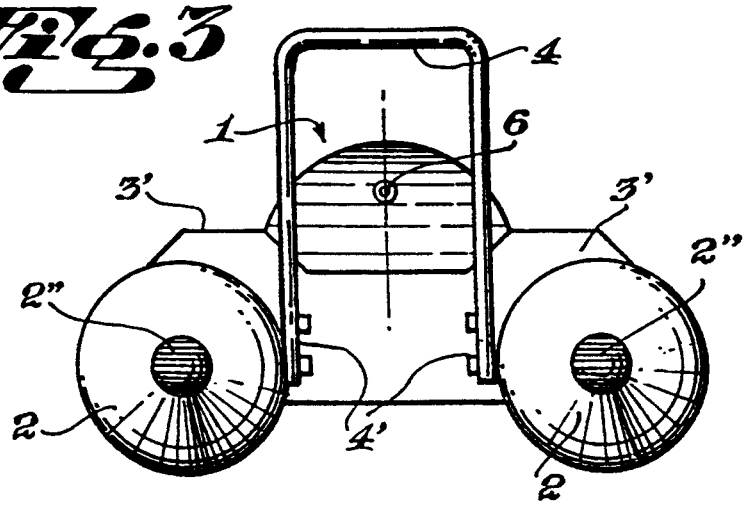
FIG. 3: a rear view of the vehicle which illustrates the rigid stern of the structure.

In general terms, the captioned water vehicle comprises an elongated floating assembly a) formed by an elongated principal float 1) which is arranged between two lateral pontoons 2), FIGS. 1 to 3. The floating structure a) consisting of a float 1) and pontoons 2), the structures may be made of a rigid material (for example glass fiber and resin), or inflatable pneumatic, structured of reinforced vinyl fabric (PVC) (at least the central float 1) so that it can be used as decompression chamber such as stated below.

More specifically, and such as can be seen in the figures, the pontoons 2) as well as the middle principal float 1) may have the same or similar length but are arranged in such a way that the bow extremity 1') of the float 1) projects longitudinally ahead with respect to the extremities 2') of the pontoons 2) whereas particularly on the opposite side, the float 1) ends in a rigid wall 1") which is arranged between the stern extremities 2") of the pontoons 2). The pontoons 2) are connected by means of a rigid transom wall 3 ) with bent edges 3'), which forms a transom and may include a rudder and also to mount an outboard motor m), etc.

The pontoons 2) are also joined to the middle principal float 1) by means of tighteners, welding seams, or a rigid brace structure g), etc.

The watertight compartment 5) is eccentrically lodged within the principal float 1). The compartment 5 is made of the same material as the hull and the compartment 5 which constitutes the stabilizer of the vehicle and which is reached through a loading orifice 6) as shown in FIG. 3. The compartment 5 may have partition walls that control the rolling effect of the ballast in the compartment 5 may be loaded with liquid 5') as ballast in a varying proportion in order to permit changing the gravity center or the floatation line in accordance with the conditions of navigability determined by the state of the water and, according to what has been explained in the first part of these specifications the compartment 5) can also be used for loading with water or fuel for the vessels achieving more autonomy (FIG. 2).

Figure 4:
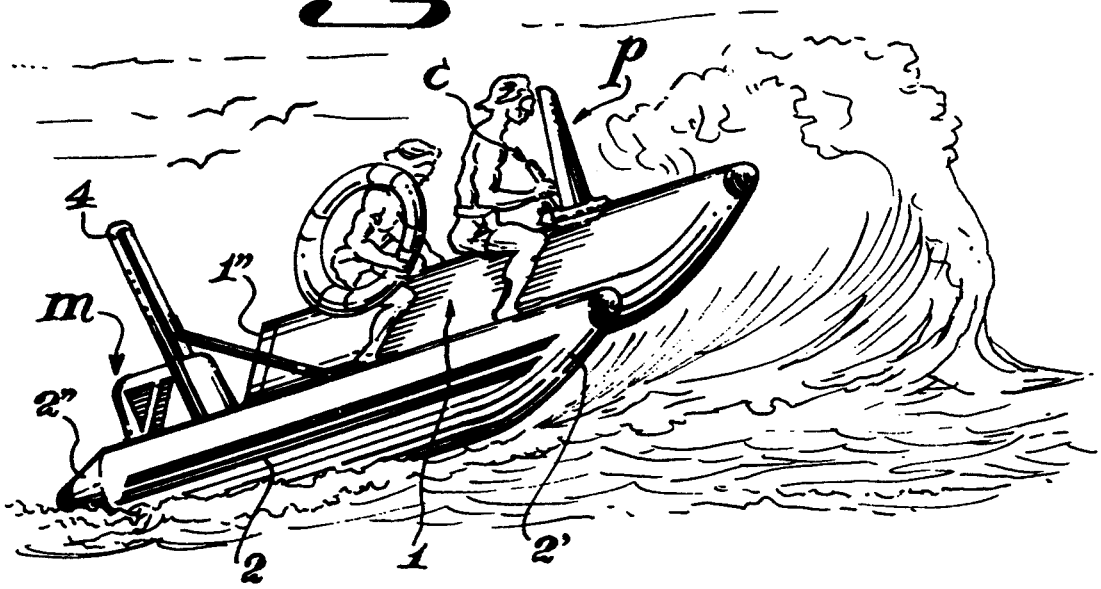
FIG. 4: a lateral view of the vessel with an outboard engine as driving means in an operative arrangement wherein said vehicle acts as some launches which raise their bow in motion; this figure also shows how the pilot and passenger "ride" on the principal float.
Figure 6:
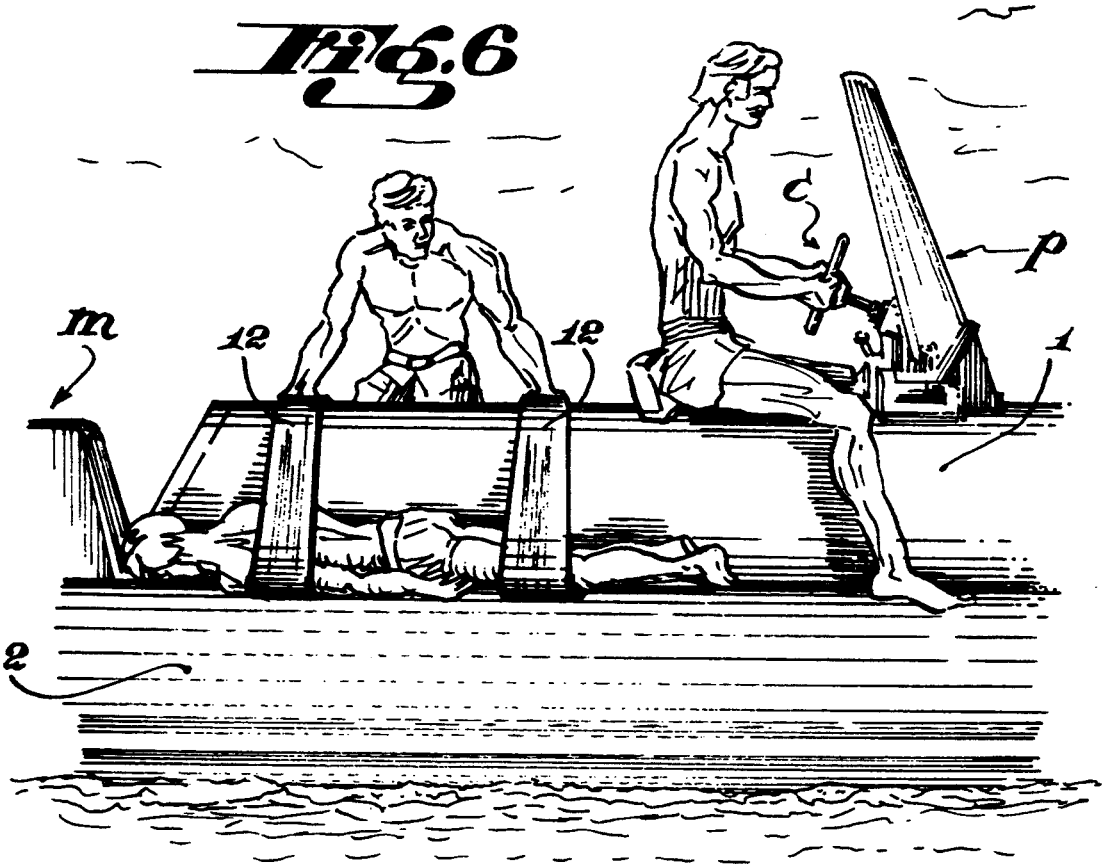
FIG. 6: is a close up of the vehicle shown, in FIG. 5 and shows a detail of a lateral view of the vehicle once the rescued person has been totally hoisted. This figure also illustrates more clearly the presence of a windscreen and a steering wheel.
Figure 9:
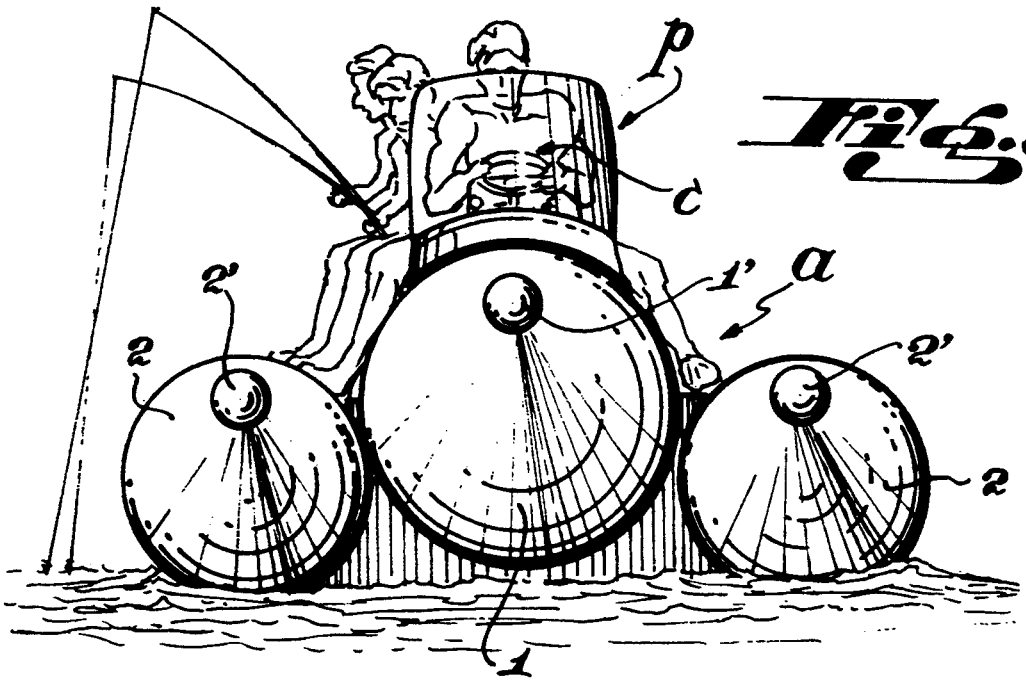
FIG. 9: is a front view of the invention to illustrate its use as sports vessel, in this case as a fishing vehicle.

In the present case, the pilot and other passengers are riding on the principal body 1) that may include a windscreen p) and a steering wheel c); the propelling means m) may be any one that is suitable such as an outboard motor, a turbine, a wind propelling helix, a wing for alternative drive within the water such as a whale tail, etc. (FIGS. 4, 6 and 9). The propelling means m) is affixed to transom 3 at the stern end of the water vehicle, to propel the vehicle forward.

The assembly may also include lateral stirrups for support and gripping means such as the inverted U bar 4) arranged in the bow area (FIGS. 1, 3, 4 and 5) the ends of which are fixed on anchoring bases 13) provided on the pontoons 2); or reins fixed in the front of the float 1).

Figure 7:
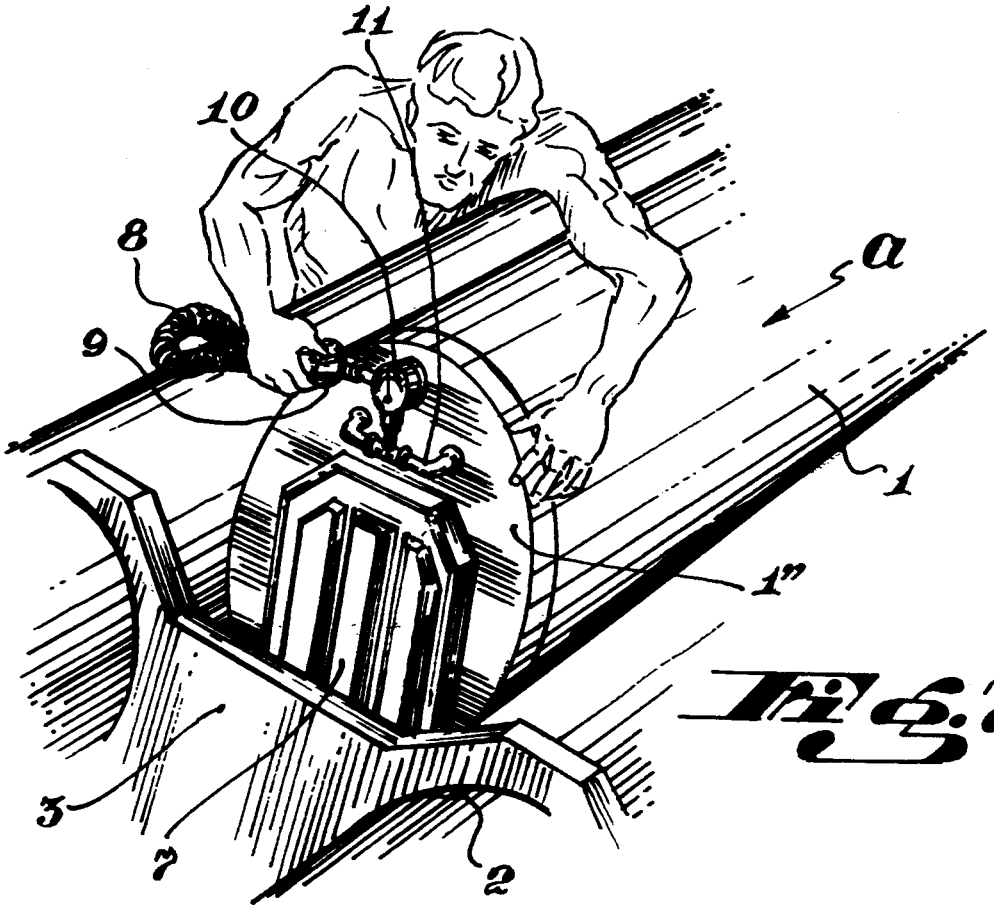
FIG. 7: a detail in perspective showing how the principal float can be used as decompression chamber. Then the treated person can be introduced through the hatchway and, once it is closed, the float can be air supplied.

One of the preferred embodiments is the one shown by FIG. 7, according to which the rear wall 1") of the float 1) is provided with a hatchway 7) that may be closed tightly, as well as the tubing 11) which connects a manometer 10) with the inside of 1) and an entrance orifice in such a way that, in case a diver enters through the hatchway 7) and the latter has been closed, the chamber formed by 1) can be used as decompressor chamber in case of emergency by injecting air by means of valve 9 and conduits 8 and, controlling the pressure with the manometer 10) for the purposes stated in the first part of the specifications.

Figure 5:
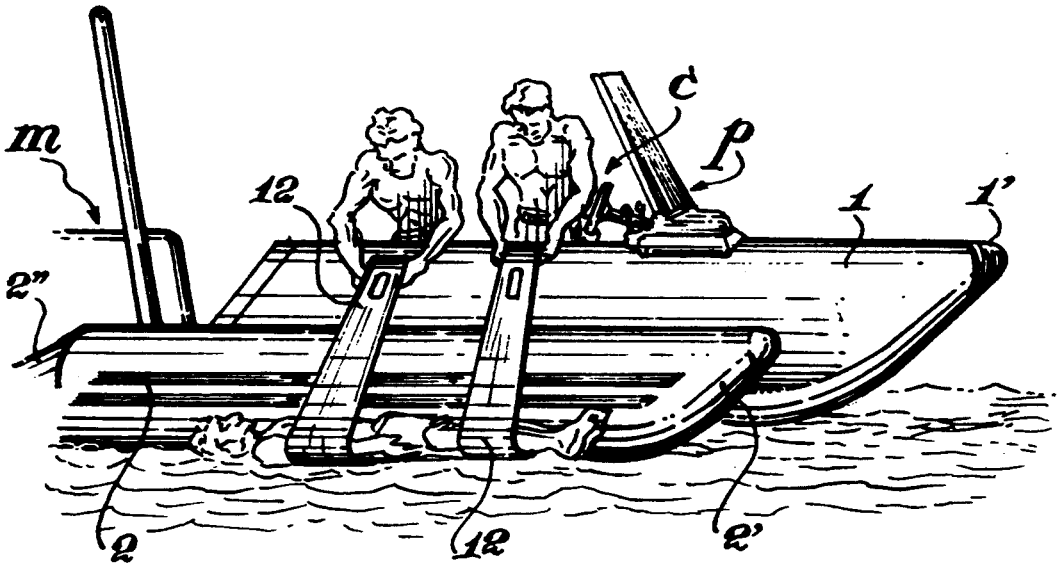
FIG. 5: a lateral view of the vessel in a rescue operation by means of transversal belts which laterally take and hoist a person from the water.

Similarly, and as has been said in the introduction herein, the vessel may be laterally provided with belts 12) that permit hoisting people from the water in case of accidents such as shown by FIGS. 5 and 6.

Figure 8:
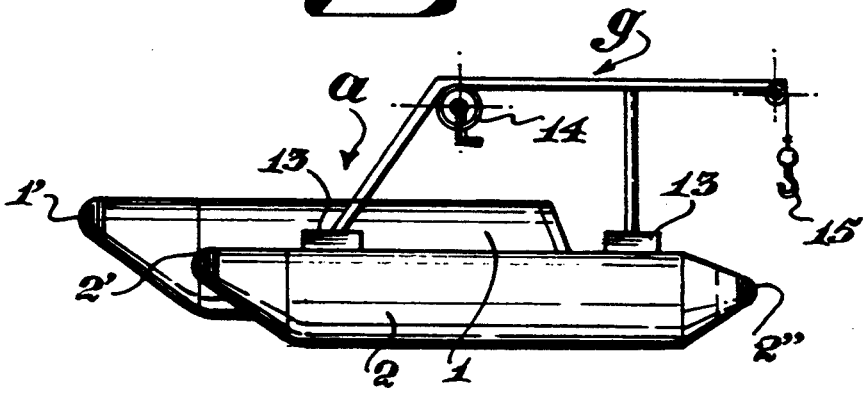
FIG. 8: a lateral view of the vehicle in a new embodiment according to which, the rigid structure is in this case prepared to act as a holster.

Finally, the invention may have an auxiliary hoist structure g) provided with a rigging set 14 and 15 to permit hoisting structures or products from the water (FIG. 8).

Figure 10:
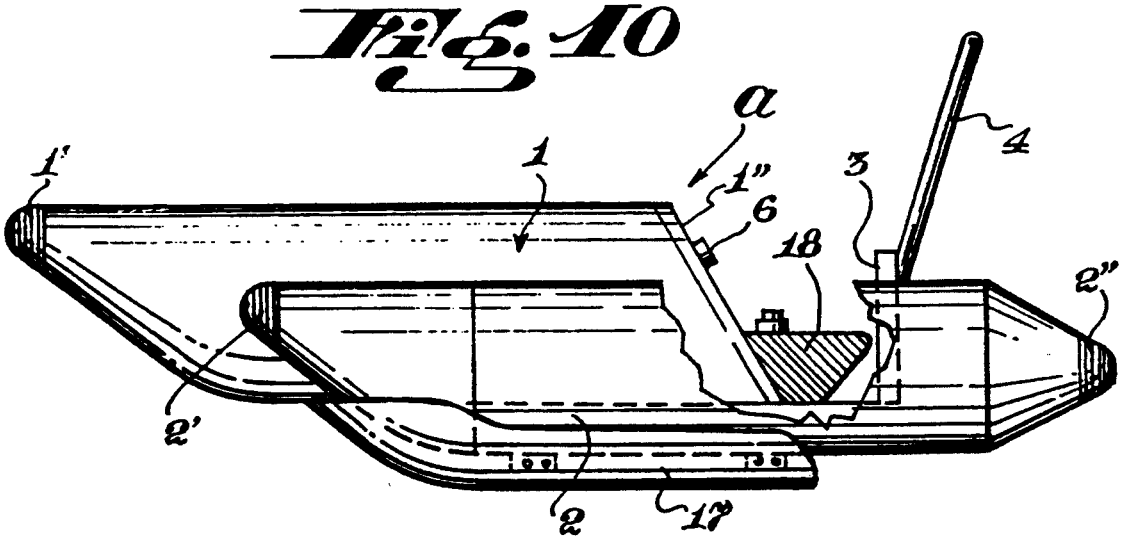
FIG. 10: is a lateral view similar to that of FIG. 2 which, in a partial section of one of the pontoons permits to appreciate the arrangement of the fuel tank which acts as connection between the lid and the transom; this embodiment also shows the pontoons provided with skis.

FIG. 10 shows an alternative detail of the fuel tank 18) of the vessel which is arranged such as stated, so that it may act as connection between the nucleus lid 1' of the principal float 1 and the transom 3).

Figure 11:
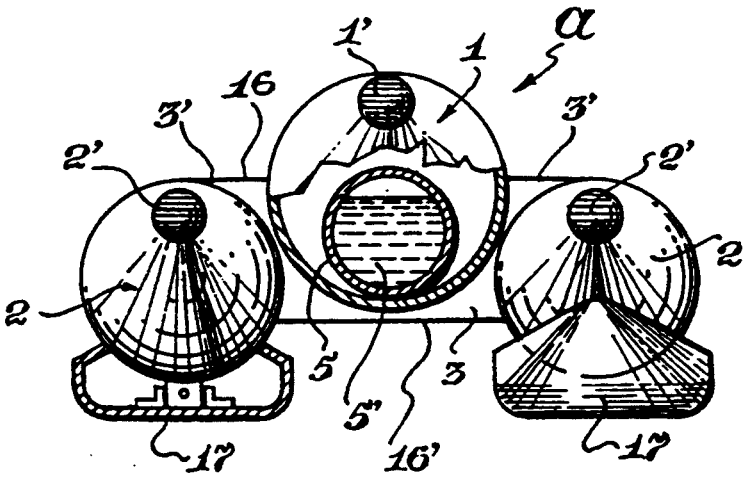
FIG. 11: a front view of the water vehicle of FIG. 10 with its belt and floor tighteners and the skis whose transversal section, substantially U shaped, permits its free borders to lean their pontoons against the walls, said borders being provided with strips in order to avoid damaging said walls.

Finally, in the embodiment of FIGS. 10 and 11, the pontoons 2) are supplied with wedges on which the skis 17) are fixed. The wedges may be short, long, with or without fins, etc. and having a substantially transversal "U" profile, its borders are supported against the walls of the pontoons 2).

There is no doubt that, in embodying the invention, modifications may be introduced with respect to certain construction and form details, without this implying getting away from the fundamental principles outlined in the following claims:

What is claimed is:

1. A water vehicle including an inflated floating set in structural connection with a propelling and steering means, said floating set comprising:

a closed tubular float having at its stern end a closeable lid, said float mounted on two lateral pontoons that project longitudinally backwards in relation with said stern end of said float;

a means for connection of said pontoons with each other, said means including a rigid wall constituting a transom extending between the stern ends of said pontoons, said transom wall being projected onto said pontoons, said pontoons being interconnected to each other and to said tubular float by means of tighteners and welding seams extending between the inner sides of said pontoons and the outer sides of said tubular float;

a compartment eccentrically lodged in the inner chamber cavity of said tubular float, said compartment forming a ballast container, said compartment based and fixed on the lower part of the inner chamber surface wall of said tubular float, said tubular float being connected to each one of said pontoons by means of said tighteners, and welding seams, fixed at one end on the sides of said tubular float and at the other end on adjacent portions of each of said pontoons.

2. The water vehicle according to claim 1, comprising a stabilizer means to stabilize the floating of said water vehicle, said means including said ballast compartment and one or more partition walls being located within said compartment fixed at each end onto opposite sides of said inner surface wall of said tubular float.

3. The water vehicle according to claim 1, wherein the floating set includes safety flexible belt reins to hoist injured persons from water.

4. A water vehicle according to claim 1, further comprising a rigid structure formed by a reversed "U" bar fixed by its ends to said transom.

* * * * *